US011603586B2

(12) United States Patent
Weber et al.

(10) Patent No.: US 11,603,586 B2
(45) Date of Patent: Mar. 14, 2023

(54) INTERIM TEMPER PROCESS

(71) Applicant: The Boeing Company, Chicago, IL (US)

(72) Inventors: Gary Robert Weber, Kent, WA (US); Clinton J. Campbell, Kent, WA (US)

(73) Assignee: The Boeing Company, Chicago, IL (US)

( * ) Notice: Subject to any disclaimer, the term of this patent is extended or adjusted under 35 U.S.C. 154(b) by 337 days.

(21) Appl. No.: 16/585,079

(22) Filed: Sep. 27, 2019

(65) Prior Publication Data

US 2021/0095364 A1 Apr. 1, 2021

(51) Int. Cl.
*C22F 1/04* (2006.01)

(52) U.S. Cl.
CPC ..... *C22F 1/04* (2013.01)

(58) Field of Classification Search
CPC .. C22F 1/04; C22F 1/002; C22F 1/053; C22C 21/10; C21D 9/00
See application file for complete search history.

(56) References Cited

U.S. PATENT DOCUMENTS

| | | | |
|---|---|---|---|
| 3,856,584 | A | 12/1974 | Cina |
| 5,496,426 | A | 3/1996 | Murtha |
| 2012/0055588 | A1 | 3/2012 | Kamat et al. |
| 2018/0202031 | A1 | 7/2018 | Wu et al. |
| 2019/0062886 | A1 | 2/2019 | Leyvraz et al. |

FOREIGN PATENT DOCUMENTS

| | | | |
|---|---|---|---|
| CN | 104703792 | A | 6/2015 |

OTHER PUBLICATIONS

Healy, "Guinier-Preston Zone Evolution in 7075 Aluminum," PhD Thesis, University of Florida, 1976, 200 pages. https://ufdcimages.uflib.ufl.edu/UF/00/09/75/06/00001/guinierprestonzo00healrich.pdf.
European Patent Office Extended Search Report, dated Feb. 15, 2021, regarding Application No. 20195985.5, 9 pages.
Office Action from European Patent Office, dated Mar. 17, 2022, regarding Application No. 20195985.5, 6 pages.
The State Intellectual Property Office of The People's Republic of China First Office Action and English Translation, dated Oct. 10, 2022, regarding Application No. CN202011025297.9, 17 pages.
The State Intellectual Property Office of The People's Republic of China Second Office Action and English Translation, dated Nov. 24, 2022, regarding Application No. CN202011025297.9, 10 pages.

*Primary Examiner* — Anthony M Liang
*Assistant Examiner* — Danny N Kang
(74) *Attorney, Agent, or Firm* — Yee & Associates, P.C.

(57) ABSTRACT

A method for forming a structure using an interim temper process is provided. A metal material is partially-aged to a stable temper that does not require cold storage. The partially-aging step is completed at a supplier facility prior to the metal material being received by the manufacturer. Once received by the manufacturer, the partially-aged metal material is heated to a first temperature to perform retrogression. A structure is formed from the partially-aged metal material after performing the retrogression. The structure is shaped and inspected. The structure is then heated to a second temperature in an age oven to reach its final aged state. The final aged state may be close to, meet, or exceed a T6 temper.

20 Claims, 7 Drawing Sheets

INTERIM TEMPER PROCESS

BACKGROUND INFORMATION

Field

The present disclosure relates generally to manufacturing metal structures. More specifically, the present disclosure relates to an interim temper process for partially aging and subsequently roll forming metal structures for aircraft applications.

Background

Although manufacturers have increasingly turned to composite materials for use in aircraft and automotive applications, metal structures are still viable options to provide structural support for these platforms. Manufacturers may use roll forming techniques to fabricate such metal structures.

Prior to roll forming, metal materials are subjected to a number of different manufacturing processes. These processes alter the properties of the metal material to make it more desirable for roll forming. Numerous processing steps require manpower, resources, equipment, time and floor space that often reduce the efficiency and increase the cost of the overall fabrication process more than desired.

Therefore, it would be desirable to have a method and apparatus that takes into account at least some of the issues discussed above, as well as other possible issues.

SUMMARY

An illustrative embodiment of the present disclosure provides a method for forming a structure. A partially-aged metal material is heated to a first temperature to perform retrogression. A structure is roll formed from the partially-aged metal material after performing the retrogression. The partially-aged metal material is not placed in cold storage before roll forming. All partially-aging is done off-site. The structure is heated to a second temperature to reach a final aged state. The final aged state may meet or exceed a T6 temper.

Another illustrative embodiment of the present disclosure provides a method for forming a structure for an aircraft. A metal material, such as 7000 series aluminum, is solution heat-treated. The metal material is then partially-aged either by heating it to a temperature of 170-190 degrees Fahrenheit for approximately four hours or less or naturally aging the metal material for up to 40 hours. The partially-aged metal material is not stored in a freezer. Instead, it remains exposed to room temperature. The partially-aged metal material is heated to a temperature between 350- and 410-degrees Fahrenheit to perform retrogression. The structure is roll formed from the partially-aged metal material after performing the retrogression. The structure is heated to reach a final aged state. The structure may be heated for approximately eighteen hours at a temperature of 250-degrees Fahrenheit.

A further illustrative embodiment of the present disclosure provides a manufacturing system comprising a heating system, a roll forming system, and an age oven. The heating system is configured to heat a partially-aged metal material to a first temperature to perform retrogression. The roll forming system is configured to roll form a structure from the partially-aged metal material after performing the retrogression. The partially-aged metal material is not placed in cold storage before roll forming. The aging oven is configured to heat the structure to a second temperature to reach a final aged state for the structure.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account one or more different considerations. For example, the illustrative embodiments recognize and take into account that the manufacturing process for roll forming aluminum stringers is often more expensive and time consuming than desired. Prior to roll forming, metal material in its annealed condition is corrugated, solution heat-treated, quenched, and held in a freezer. Current solutions employ an on-site solution heat-treating and cold storage process that requires holding freshly quenched material in freezers at −10 degrees Fahrenheit before forming the stringer. Cold storage slows the natural aging process of the metal, aging that would occur if it was stored at room temperature. Therefore, it is important to limit the time the metal material is exposed to room temperature before the roll forming process starts to maintain a desired strength level that still allows formability.

Additionally, the solution heat-treating, quenching, and freezing steps make the entire process take longer and cost more than desired. Having a simpler process would save in manpower and storage costs.

Thus, the disclosed embodiments relate to a method for forming a structure. A metal material is partially-aged to a stable temper that does not require cold storage. Ideally, the metal is partially-aged offsite by a supplier. Once at the manufacturing facility, the partially-aged metal material is heated to a first temperature to perform retrogression. A structure is formed from the partially-aged metal material after performing the retrogression. The structure is shaped and inspected as usual. The structure is then heated to a second temperature in an age oven to reach its final aged state. The final aged state may be close to a T6 temper. Using the method described herein, the final aging step may be completed in less time than with currently used processes.

Figure 1:
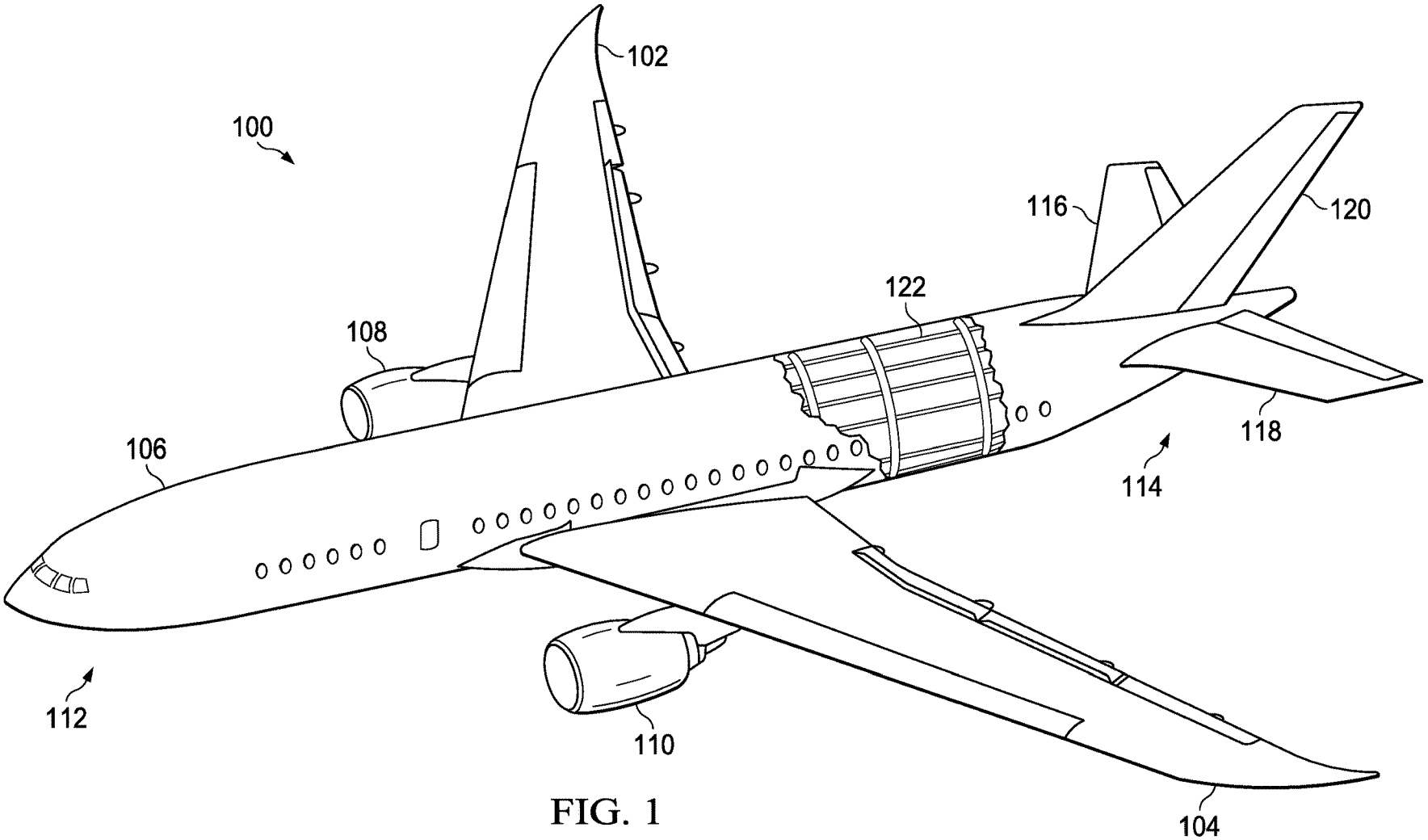
FIG. 1 is an illustration an aircraft in accordance with an illustrative embodiment.

With reference now to the figures and, in particular, with reference to FIG. 1, an illustration of an aircraft is depicted in accordance with an illustrative embodiment. In this illustrative example, aircraft 100 has wing 102 and wing 104 attached to fuselage 106.

Aircraft 100 includes engine 108 attached to wing 102 and engine 110 attached to wing 104.

Fuselage 106 has nose section 112 and tail section 114. Horizontal stabilizer 116, horizontal stabilizer 118, and vertical stabilizer 120 are attached to tail section 114 of fuselage 106. Fuselage 106 has stringers 122.

Figure 2:
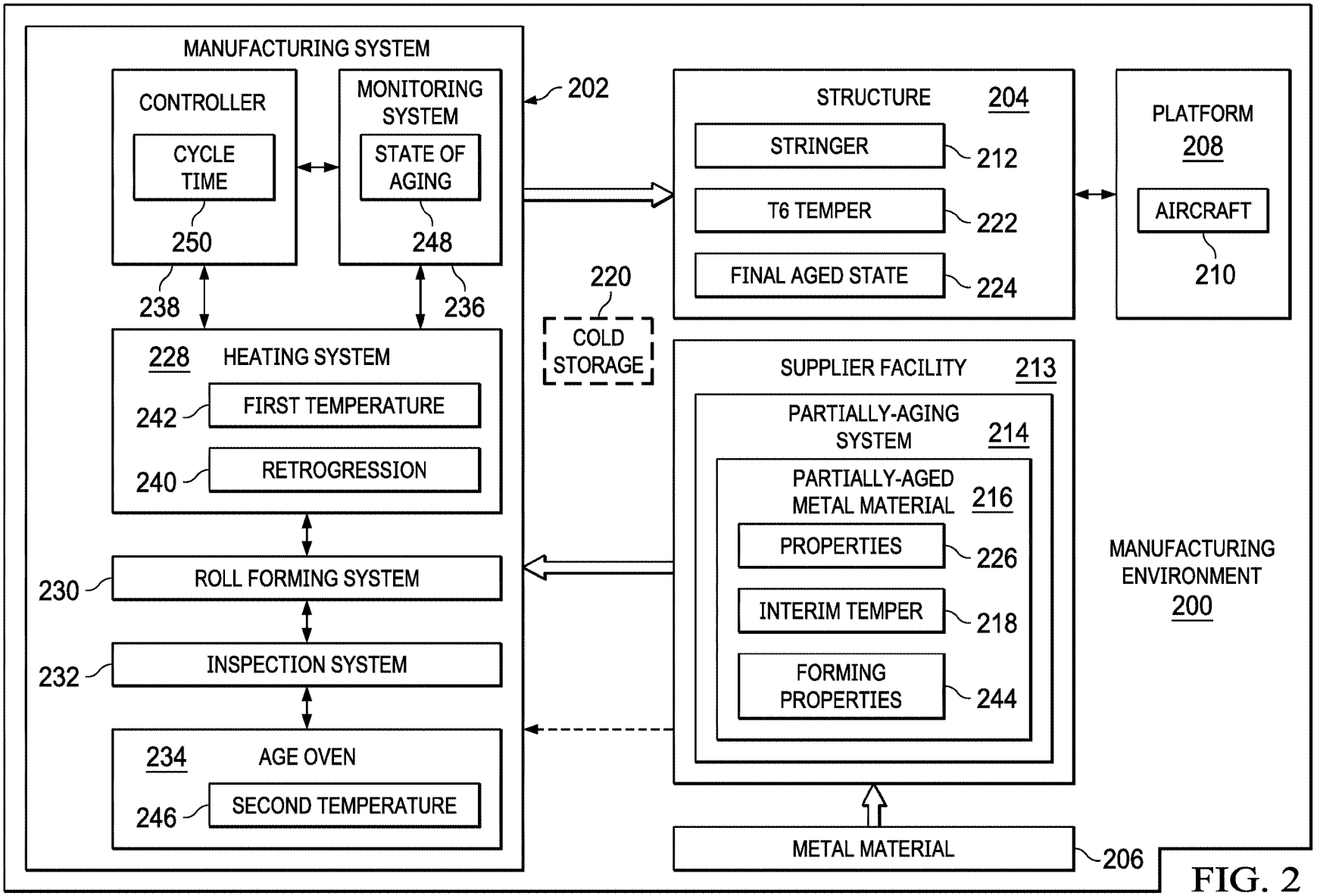
FIG. 2 is an illustration of a block diagram of a manufacturing environment in accordance with an illustrative embodiment.

Turning now to FIG. 2, an illustration of a block diagram of a manufacturing environment is depicted in accordance with an illustrative embodiment. Manufacturing environment 200 is an environment where components within manufacturing system 202 may be used to form structure 204.

Structure 204 is a structure made from metal material 206 and configured for use in platform 208. Metal material 206 may comprise at least one of an aluminum, an aluminum alloy, or some other suitable type of material. Specifically, metal material 206 may be a 7000-series aluminum alloy such as, for example, without limitation, 7075 aluminum alloy. Metal material 206 is in its annealed condition in this illustrative example.

As used herein, the phrase "at least one of," when used with a list of items, means different combinations of one or more of the listed items may be used, and only one of each item in the list may be needed. In other words, "at least one of" means any combination of items and number of items may be used from the list, but not all of the items in the list are required. The item may be a particular object, a thing, or a category.

For example, "at least one of item A, item B, or item C" may include, without limitation, item A, item A and item B, or item B. This example also may include item A, item B, and item C, or item B and item C. Of course, any combination of these items may be present. In other examples, "at least one of" may be, for example, without limitation, two of item A, one of item B, and ten of item C; four of item B and seven of item C; or other suitable combinations.

Platform 208 may be, for example, without limitation, a mobile platform, a stationary platform, a land-based structure, an aquatic-based structure, or a space-based structure. More specifically, platform 208 may be an aircraft, a surface ship, a tank, a personnel carrier, a train, a spacecraft, a space station, a satellite, a submarine, an automobile, a power plant, a bridge, a dam, a house, a manufacturing facility, a building, and other suitable platforms.

Platform 208 takes the form of aircraft 210 in this illustrative example. When structure 204 is manufactured for aircraft 210, structure 204 may be, for example, without limitation, a fuselage stringer, a frame, a skin panel, a skin doubler, or some other suitable structure configured for use in aircraft 210. In this illustrative example, structure 204 takes the form of stringer 212. Stringer 212 is a fuselage stringer in this illustrative example. One of stringers 122 shown in FIG. 1 may be a physical implementation for stringer 212.

Metal material 206 goes through a partial-aging process prior to being formed into structure 204. In this depicted example, the partial-aging process occurs at supplier facility 213. However, the partial-aging process also may be completed at the manufacturing facility in some illustrative examples.

In some illustrative examples, partial-aging includes natural aging processes. For instance, metal material 206 may be solution heat-treated and then allowed to naturally age at room temperature to reach a desired Rockwell hardness.

Partial-aging system 214 comprises a number of components configured to solution heat treat and age metal material 206 to form partially-aged metal material 216. As used herein, "a number of" when used with reference to items means one or more items. Thus, a number of components is one or more components.

Partial-aging system 214 ages metal material 206 to interim temper 218 in various ways. For example, without limitation, metal material 206 may be solution heat treated and aged by exposure to temperatures between 170- and 190-degrees Fahrenheit. Exposure to such temperatures may be for less than four hours. Preferably, metal material 206 may be exposed to such temperatures for two to four hours. Of course, other temperatures and time intervals may be implemented. For instance, metal material 206 may be exposed to 170-degrees Fahrenheit for up to 24 hours or more, depending on the particular implementation. This aging process may be referred to as an "interim aging process" or "interim temper aging" or "pre-aging" throughout this disclosure.

Interim temper 218 is a stable temper at which partially-aged material 216 can be stored at room temperature without substantially affecting the formability of partially-aged material 216, therefore eliminating the need for cold storage 220. As an example, interim temper 218 is lower than T6 temper 222 of structure 204 in final aged state 224 of structure 204. Interim temper 218 develops a yield strength that is intermediate between as-quenched (prior art) and fully aged conditions.

In other illustrative examples, metal material 206 is not partially-aged through heating. Instead, metal material 206 is naturally aged at room temperature. Natural aging can occur for approximately four to twenty-four hours or more. In some illustrative examples, metal material 206 is naturally aged for up to forty hours or more. In other words, in the case of natural aging, metal material 206 is exposed to a temperature of 170- and 190-degrees Fahrenheit for zero hours.

As depicted, partially-aged metal material 216 has properties 226. Properties 226 may comprise at least one of Rockwell hardness, ultimate tensile strength, elongation, tensile yield stress, and other desirable properties to ensure that partially-aged metal material 216 can be roll formed into structure 204 without failure.

For example, without limitation, after the interim aging process, partially-aged metal material 216 comprises a yield stress between 32 and 50 ksi and an elongation value of between 20 and 25 ksi. Preferably, partially-aged metal material 216 has a yield stress of between 45 and 49 ksi prior to retrogression.

Partially-aged metal material 216 also may have a difference in value of ultimate tensile strength (UTS) and tensile yield strength (TYS), i.e, UTS-TYS, of 25 to 30 ksi. Properties 226 differ based on how long metal material 206 is partially-aged. The values disclosed herein for yield stress, UTS-TYS ratio, and other properties 226 are just examples of some desirable ranges.

Once partially-aged metal material 216 is formed, it is transported to a manufacturing facility that will fabricate structure 204 using manufacturing system 202. Partially-aged metal material 216 is never placed in cold storage 220.

As depicted, manufacturing system 202 comprises heating system 228, roll forming system 230, inspection system 232, age oven 234, monitoring system 236, and controller 238. Manufacturing system 202 may comprises a number of additional components as well, depending on the particular implementation.

In this illustrative example, heating system 228 performs retrogression 240 on partially-aged metal material 216 when received from supplier facility 213. Specifically, heating system 228 is configured to heat partially-aged metal material 216 to first temperature 242 to perform retrogression 240. For example, without limitation, heating system 228 may include a hot plate, a thermal heater, a conduction heating device, or some other suitable device.

First temperature 242 is selected such that partially-aged metal material 216 has forming properties 244 after retrogression 240. First temperature 242 may be approximately 400 degrees Fahrenheit in this illustrative example. Partially-aged metal material 216 may be exposed to first temperature 242 for any amount of time less than five minutes, depending on the exact aged state of interim temper 218. For example, without limitation, partially-aged metal material 216 may be exposed to first temperature 242 (400 degrees Fahrenheit) for a few seconds to five minutes. Retrogression 240 may be achieved almost instantaneously in some illustrative examples. Other temperatures and time periods also may be used, depending on the particular implementation. For example, partially-aged metal material 216 may reach desired parameters after a matter of seconds exposed to 300-degrees, 330-degrees, 340-degrees Fahrenheit, or some other temperature.

In this illustrative example, forming properties 244 are selected to optimize formability of partially-aged metal material 216. Forming properties 244 may comprise at least one of Rockwell hardness, ultimate tensile strength, elongation, tensile yield stress, and other desirable properties. In this depicted example, it is desirable for partially-aged metal material 216 to comprise a yield stress between 32 and 45 ksi after retrogression 240. Preferably, partially-aged metal material 216 comprises a yield stress of between 40 and 42 ksi after retrogression 240, compared to approximately 32 ksi with freshly quenched metal material. In this manner, retrogression 240 decreases yield stress.

As another example, it may be desirable for partially-aged metal material 216 to comprise a UTS-YTS of between 25 and 30 ksi after retrogression 240. Retrogression 240 is utilized such that forming properties 244 of partially-aged metal material 216 are as close to the as-quenched condition as possible, or, in some cases, more optimal than the as-quenched condition.

Various aging techniques influence the Rockwell hardness of partially-aged metal material 216 as compared to as-quenched material (prior art). As-quenched material may have a Rockwell hardness of approximately 40 HRB immediately after quenching. If partially-aged material 216 is naturally aged, it may have a Rockwell hardness of approximately 53 HRB after four hours and approximately 65 HRB after twenty-four hours. Using partial-aging system 214, partially-aged metal material 216 may have a Rockwell hardness of approximately 71 HRB after one-hour exposure to 170-degrees Fahrenheit and approximately 75 HRB after two-hour exposure to 170-degrees Fahrenheit. Retrogression 240 decreases Rockwell hardness to a value ideal for roll forming.

After retrogression, partially-aged metal material 216 is roll formed into structure 204 using roll forming system 230. Roll forming system 230 may comprises a number of components configured to shape, cut, trim, contour, or otherwise fabricate structure 204 from partially-aged metal material 216.

Inspection system 232 is configured to inspect structure 204 after roll forming and before being placed in age oven 234. Inspection system 232 may comprise mechanical, electrical, computer-controlled or human components.

After inspection, structure 204 is placed in age oven 234. Age oven 234 comprises heating components configured to heat structure 204 to second temperature 246 for a period of time to reach final aged state 224 for structure 204.

In this illustrative example, second temperature 246 may be a temperature between 200- and 300-degrees Fahrenheit. Because the material used for structure 204 has been partially-aged as described herein, final aging time can be reduced. For example, without limitation, age oven 234 may be configured to heat structure 204 at 250-degrees Fahrenheit for 18 hours, as opposed to 23 hours as with currently used systems, to reach final age state 224. Final age state 224 may be close to, meet, or exceed the properties for T6 temper 222.

In some illustrative examples, monitoring system 236 is associated with heating system 228. Monitoring system 236 comprises a number of components and sensors which monitor state of aging 248 of partially-aged metal material 216. Information from monitoring system 236 is transmitted to controller 238. Controller 238 is configured to determine cycle time 250 for retrogression 240 based on state of aging 248 of partially-aged metal material 216 to optimize the parameters for forming properties 244. Controller 238 may be part of an integrated controller that controls other processes in manufacturing system 202 or may be a separate component. In some illustrative examples, monitoring system 236 is absent.

With an illustrative embodiment, manufacturing structure 204 using partially-aged metal material 216 may take less time than with traditional techniques. Because metal material 206 is interim aged at supplier facility 213, manufacturers must complete fewer steps to form structure 204, and cold storage 220 is eliminated.

Figure 3A:
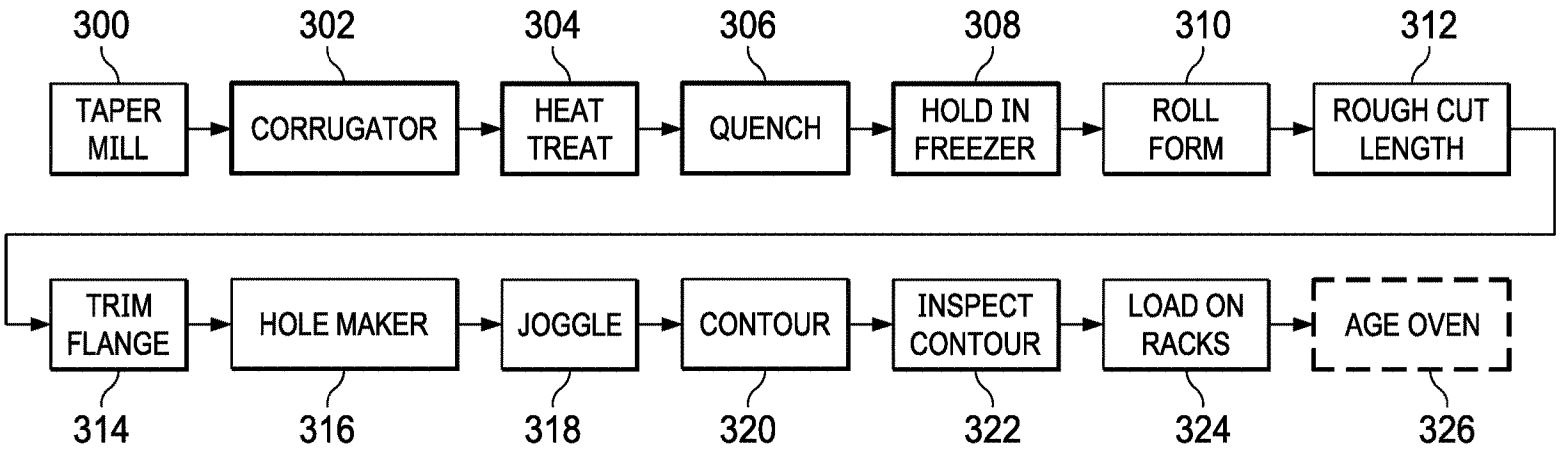
FIG. 3A (PRIOR ART)
FIG. 3A is an illustration of a flowchart of a roll forming process in accordance with the prior art.
Figure 3B:
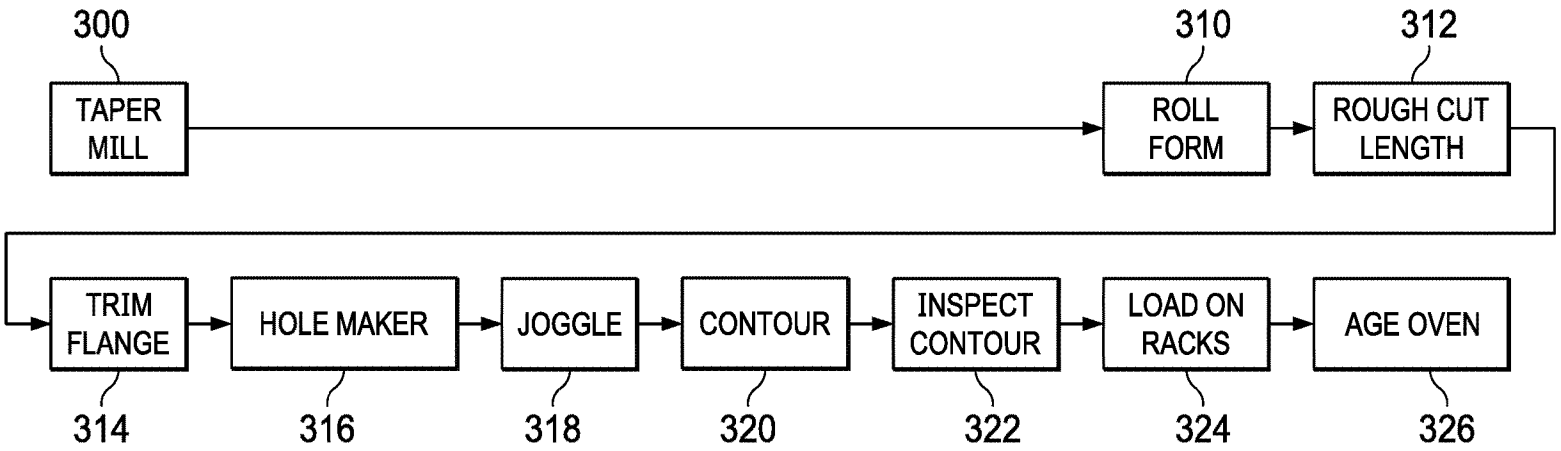
FIG. 3B is an illustration of a flowchart of a roll forming process in accordance with an illustrative embodiment.

FIG. 3A and FIG. 3B highlight the differences between currently used techniques and the method described in FIG. 2. FIG. 3A is an illustration of a flowchart of a roll forming process in accordance with the prior art, while FIG. 3B is an illustration of a flowchart of a roll forming process in accordance with an illustrative embodiment.

In FIG. 3A, material is received from the supplier in the annealed state. The material is taper milled (operation 300) before being corrugated, heat treated, quenched, and held in a freezer (operations 302-308). Only when fabrication is about to take place does the manufacturer pull the material out of the freezer and complete the roll forming process (operation 310). Once the structure is formed, it may go through a variety of additional processes such as cutting, flange trimming, hole making, joggling, and contouring (operations 312-320) before being inspected (operation 322), and loaded on racks which are delivered to the age oven (operation 324). The structure is then aged to its final state (operation 326). Typically, the final aging process takes twenty hours or more.

In FIG. 3B, material is received in the partially-aged condition, thus eliminating the need for operations 302-308. All other operations are performed in the same manner as in FIG. 3A except for final aging (operation 326). When the partially-aging process is completed using the solution heat treating method, the length of final aging is reduced. When the partially-aging process is done using natural aging at room temperature, the final aging process may not be reduced; however, the elimination of operations 302-308 improves cycle time and allows structure 204 to be fabricated much more quickly than before. In addition, the processes described herein contemplate a final aged state that is close to or exceeds a T6 temper, which produces substantially the same result as with the quenching process.

Figure 4:
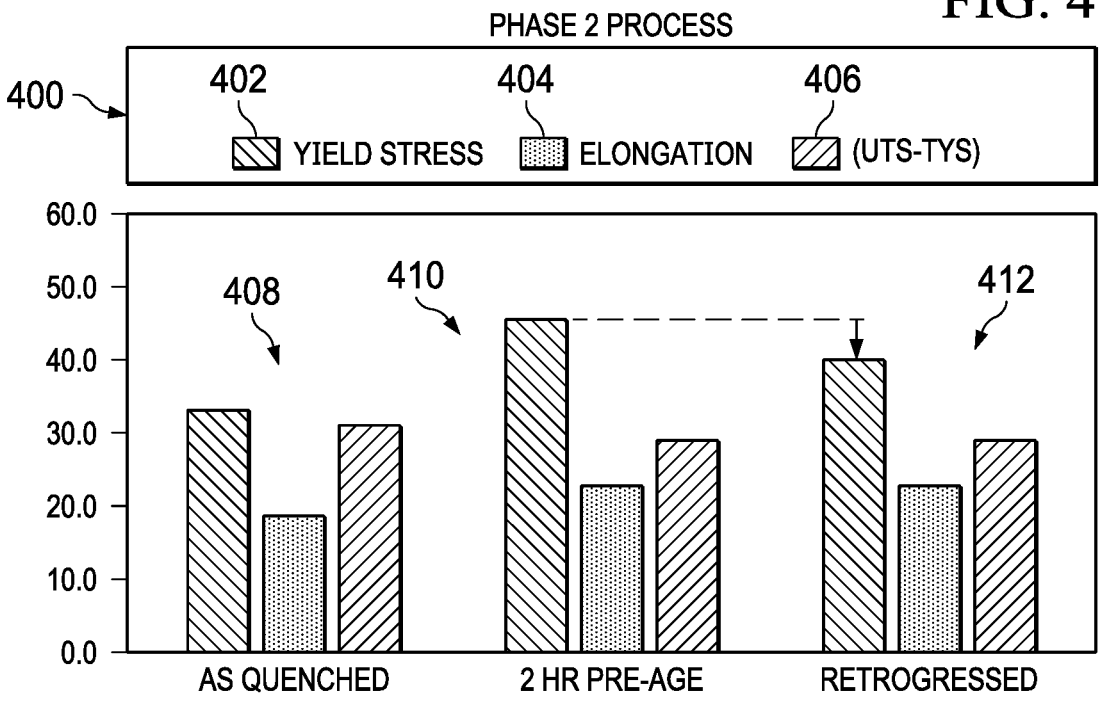
FIG. 4 is an illustration of a graph showing properties of a partially-aged metal material in accordance with an illustrative embodiment.

Turning now to FIG. 4, an illustration of a graph showing various properties of a partially-aged metal material is depicted in accordance with an illustrative embodiment. FIG. 4 shows the properties of 7075 aluminum alloy after different processes have been performed. FIG. 4 illustrates a side-by-side comparison of data taken in the as-quenched condition, after partially-aging, and after retrogression as described with reference to FIG. 2. Properties 400 include yield stress 402, elongation 404, and UTS-TYS 406. UTS-TYS 406 represents the difference in ultimate tensile strength and tensile yield stress.

As illustrated, graph 408 shows properties 400 of 7075 aluminum in the as-quenched condition. Graph 410 shows properties 400 of 7075 aluminum after two hours of partially-aging at approximately 170-degrees Fahrenheit. Graph 412 shows properties 400 of 7075 aluminum after retrogression but before roll forming.

Figure 5:
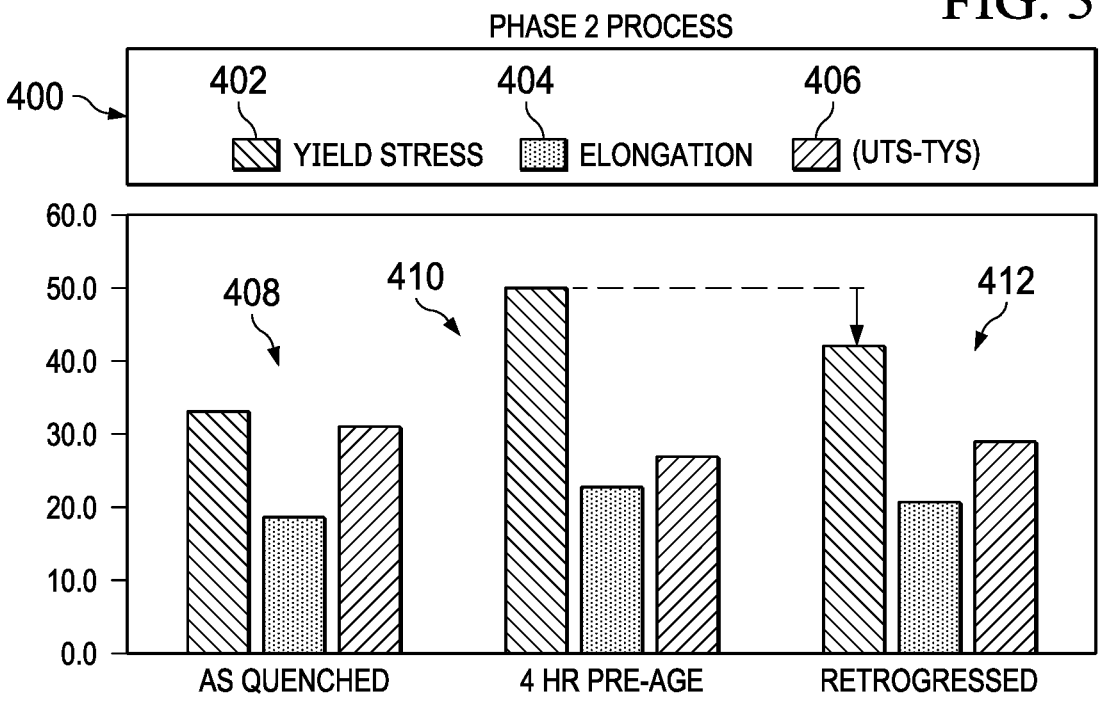
FIG. 5 is an illustration of a graph showing properties of a partially-aged metal material in accordance with an illustrative embodiment.

With reference next to FIG. 5, an illustration of a graph showing various properties of a partially-aged metal material is depicted in accordance with an illustrative embodiment. FIG. 5 shows properties of 7075 aluminum alloy after different processes have been performed. FIG. 5 also illustrates a side-by-side comparison of data taken in the as-quenched condition, after partially-aging, and after retrogression as described with reference to FIG. 2. In FIG. 5, properties 400 are shown after 7075 aluminum has been partially-aged at approximately 170-degrees Fahrenheit for four hours.

Figure 6:
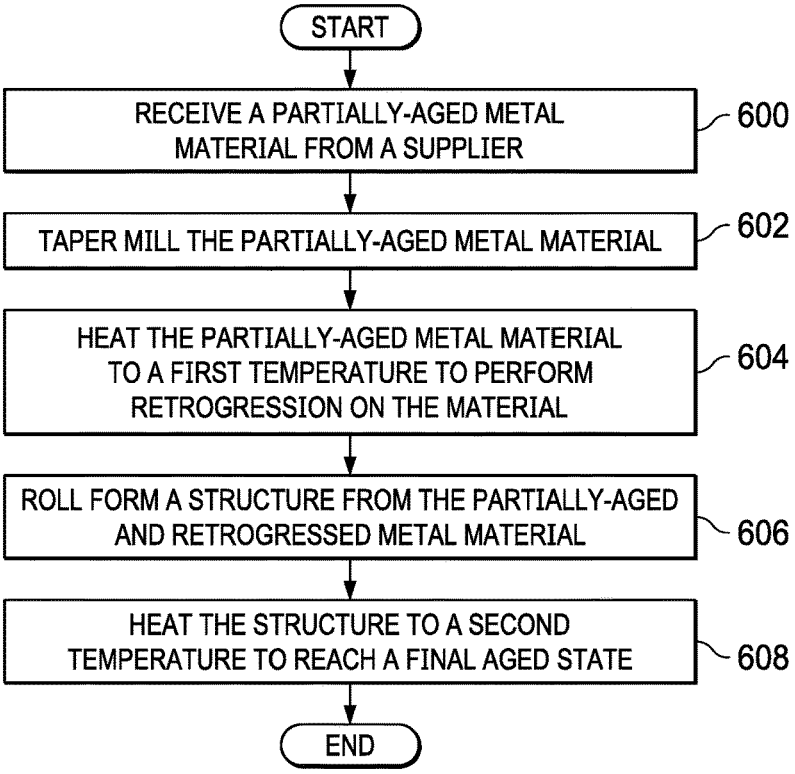
FIG. 6 is an illustration of a flowchart of a process for roll forming a structure for an aircraft in accordance with an illustrative embodiment.

Turning next to FIG. 6, an illustration of a flowchart of a process for roll forming a structure is depicted in accordance with an illustrative embodiment. The method depicted in FIG. 6 may be used to form structure 204 using manufacturing system 202 shown in FIG. 2.

The process begins by receiving a partially-aged metal material from a supplier (operation 600). Next, the partially-aged metal material is taper milled (operation 602). The process then heats the partially-aged metal material to a first temperature to perform retrogression on the material (operation 604).

Next, a structure is roll formed from the partially-aged and retrogressed metal material (operation 606). The structure is then heated to a second temperature to reach a final aged state (operation 608), with the process terminating thereafter. After reaching the final aged state at the desired temper, the structure is air cooled.

Figure 7:
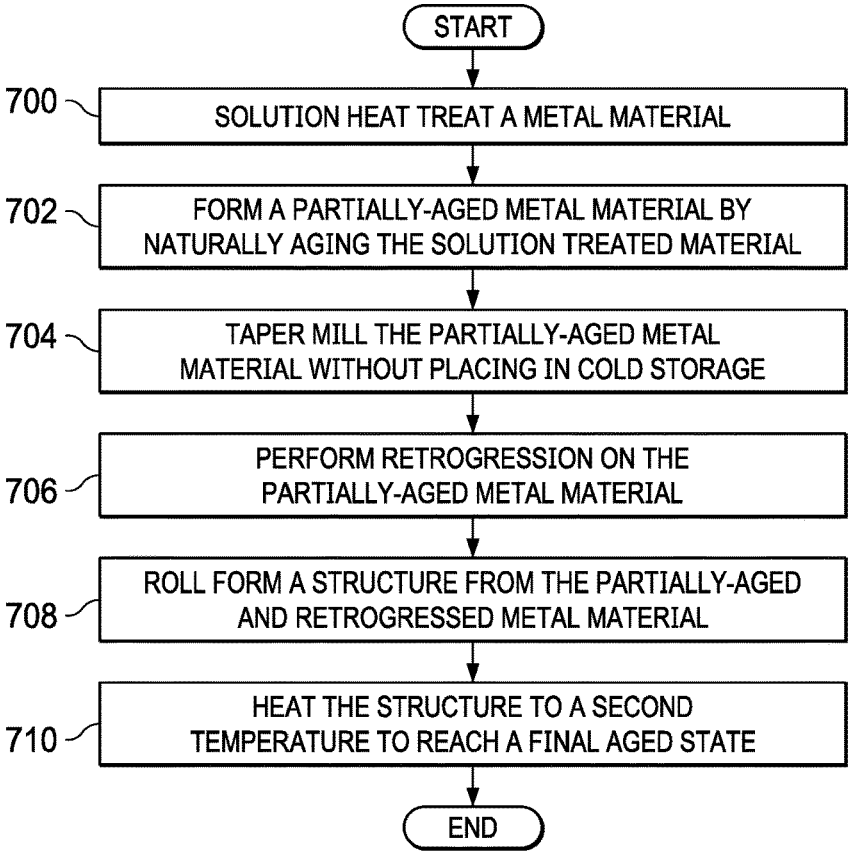
FIG. 7 is another illustration of a flowchart of a process for roll forming a structure for an aircraft in accordance with an illustrative embodiment.

FIG. 7 illustrates another flowchart of a process for roll forming a structure in accordance with an illustrative embodiment. The method depicted in FIG. 7 may be used to form structure 204 with manufacturing system 202 shown in FIG. 2. This method provides an alternative embodiment wherein the interim aging step is completed at the manufacturing facility.

The process begins by solution heat treating a metal material (operation 700). A partially-aged material is formed by naturally aging the solution treated material (operation 702). The partially-aged metal material is taper milled without being placed in cold storage (operation 704). The process then performs retrogression on the partially-aged metal material (operation 706).

Next, a structure is roll formed from the partially-aged and retrogressed metal material (operation 708). The structure is then heated to a second temperature to reach a final aged state (operation 710), with the process terminating thereafter.

Figure 8:
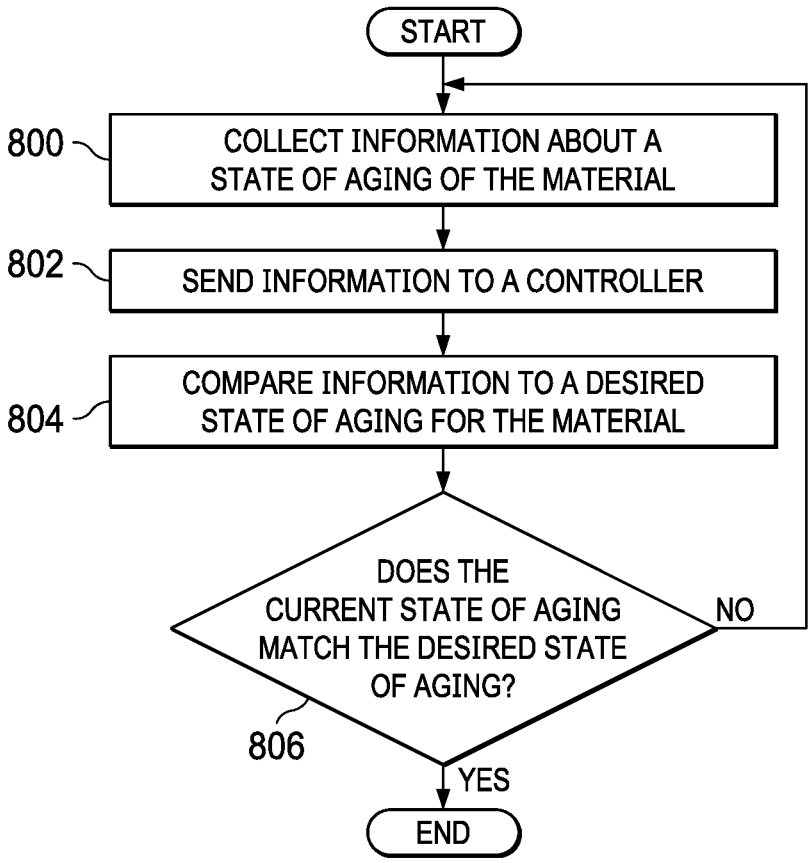
FIG. 8 is an illustration of a flowchart of a process for monitoring retrogression of a partially-aged metal material in accordance with an illustrative embodiment.

With reference next to FIG. 8, an illustration of a flowchart of a process for monitoring retrogression of a partially-aged metal material is depicted in accordance with an illustrative embodiment. The method depicted in FIG. 8 may be used to monitor state of aging 248 of partially-aged metal material 216 during retrogression 240 shown in FIG. 2. The process may be implemented during operation 604 in FIG. 6 or operation 706 in FIG. 7.

The process begins by collecting information about a state of aging of the material (operation 800). This information may include properties, temperature, precipitate state, or other desired information.

The information is sent to a controller (operation 802), where it is compared to a desired state of aging for the material (operation 804). A determination is made as to whether the current state of aging matches the desired state of aging (operation 806). If the current state of aging matches the desired state of aging, retrogression is terminated (operation 808), thus terminating the process. If the current state of aging does not match the desired state of aging, the process returns to operation 800. In this manner, manufacturing system 202 with monitoring system 236 and controller 238 can give real time feedback to manipulate cycle time 250 for retrogression 240 in FIG. 2.

The flowcharts and block diagrams in the different depicted illustrative embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step.

Figure 9:
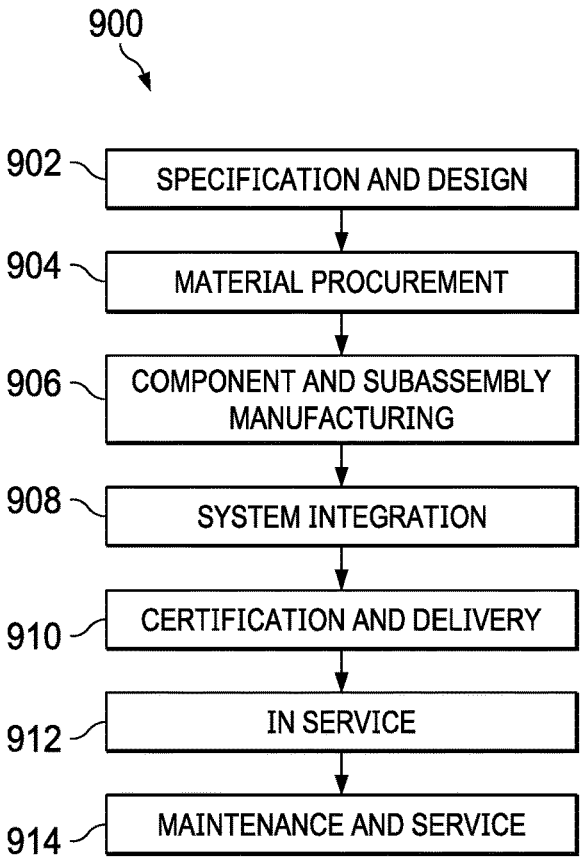
FIG. 9 is an illustration of a block diagram of an aircraft manufacturing and service method in accordance with an illustrative embodiment.
Figure 10:
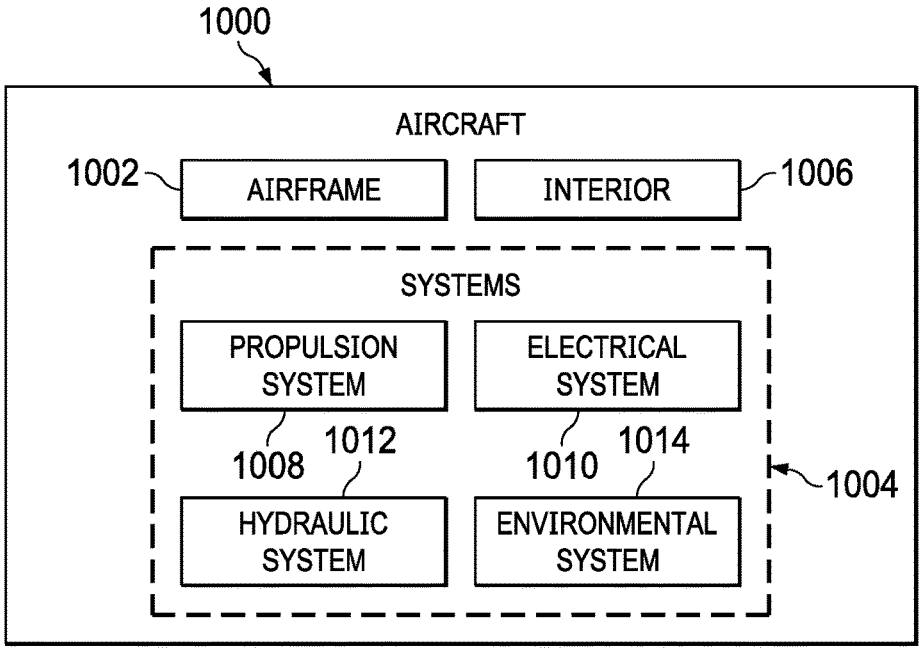
FIG. 10 is an illustration of a block diagram of an aircraft in which an illustrative embodiment may be implemented.

Illustrative embodiments of the disclosure may be described in the context of aircraft manufacturing and service method 900 as shown in FIG. 9 and aircraft 1000 as shown in FIG. 10. Turning first to FIG. 9, an illustration of a block diagram of an aircraft manufacturing and service method is depicted in accordance with an illustrative embodiment. During pre-production, aircraft manufacturing and service method 900 may include specification and design 902 of aircraft 1000 in FIG. 10 and material procurement 904.

During production, component and subassembly manufacturing 906 and system integration 908 of aircraft 1000 in FIG. 10 takes place. Thereafter, aircraft 1000 in FIG. 10 may go through certification and delivery 910 in order to be placed in service 912. While in service 912 by a customer, aircraft 1000 in FIG. 10 is scheduled for routine maintenance and service 914, which may include modification, reconfiguration, refurbishment, and other maintenance or service.

Manufacturing system 202 from FIG. 2 and the components within manufacturing system 202 may be used to fabricate structure 204 from partially-aged metal material 216 during component and subassembly manufacturing 906, after partially-aged metal material 216 is received from supplier facility 213. In addition, manufacturing system 202 may be used for parts made for routine maintenance and service 914 as part of a modification, reconfiguration, or refurbishment of aircraft 1000 in FIG. 10.

Each of the processes of aircraft manufacturing and service method 900 may be performed or carried out by a system integrator, a third party, an operator, or some combination thereof. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 10, an illustration of a block diagram of an aircraft is depicted in which an illustrative embodiment may be implemented. In this example, aircraft 1000 is produced by aircraft manufacturing and service method 900 in FIG. 9 and may include airframe 1002 with plurality of systems 1004 and interior 1006. Examples of systems 1004 include one or more of propulsion system 1008, electrical system 1010, hydraulic system 1012, and environmental system 1014. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 900 in FIG. 9. In one illustrative example, components or subassemblies produced in component and subassembly manufacturing 906 in FIG. 9 may be fabricated or manufactured in a manner similar to components or subassemblies produced while aircraft 1000 is in service 912 in FIG. 9. As yet another example, one or more apparatus embodiments, method embodiments, or a combination thereof may be utilized during production stages, such as component and subassembly manufacturing 906 and system integration 908 in FIG. 9. One or more apparatus embodiments, method embodiments, or a combination thereof may be utilized while aircraft 1000 is in service 912, during maintenance and service 914 in FIG. 9, or both. The use of a number of the different illustrative embodiments may substantially expedite the assembly of aircraft 1000, reduce the cost of aircraft 1000, or both expedite the assembly of aircraft 1000 and reduce the cost of aircraft 1000.

The illustrative embodiments decrease fabrication times for structures used in aircraft and automotive applications. The reduction in manpower and equipment, as well as the elimination of processing steps, promotes efficiency and saves money for manufacturers. With the use of an illustrative embodiment, no cold storage is needed. Final aging cycle time is reduced in some cases, thus making it faster and easier to produce structural components for aircraft.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added, in addition to the illustrated blocks, in a flowchart or block diagram.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method for forming a structure, the method comprising:

solution heat-treating a metal material to a stable temper that does not require cold storage before retrogression to obtain a partially-aged metal material;

heating the partially-aged metal material to a first temperature to perform retrogression;

roll forming the structure from the partially-aged metal material after performing the retrogression, wherein the partially-aged metal material is not placed in cold storage before roll forming; and heating the structure to a second temperature to reach a final aged state after roll forming, wherein the final aged state is a T6 temper.

2. The method of claim 1, wherein solution heat-treating comprises:

forming the partially-aged metal material by heating the metal material to a temperature of between 170- and 190-degrees Fahrenheit for less than four hours.

3. The method of claim 1, wherein solution heat-treating comprises:

forming the partially-aged metal material by naturally aging the metal material at room temperature for up to 40 hours to reach a desired Rockwell hardness.

4. The method of claim 1 wherein the partially-aged metal material is received from a supplier facility.

5. The method of claim 1, wherein the partially-aged metal material comprises a yield stress between 32 and 50 ksi prior to the retrogression, and wherein the partially-aged metal material comprises a yield stress between 32 and 45 ksi after the retrogression.

6. The method of claim 5, wherein heating the partially-aged metal material to the first temperature to perform the retrogression comprises:

heating the partially-aged metal material to approximately 400-degrees Fahrenheit for two to five minutes.

7. The method of claim 5, wherein the partially-aged metal material comprises a difference in ultimate tensile strength and tensile yield strength of between 25 and 30 ksi after the retrogression.

8. The method of claim 7 further comprising:

monitoring a state of aging during the retrogression; and determining a cycle time for the retrogression based on the state of aging.

9. The method of claim 1 further comprising:

taper machining the partially-aged metal material, wherein the partially-aged metal material is not quenched after the taper machining or before the roll forming.

10. A method for forming a stringer for an aircraft, the method comprising:

receiving a partially-aged metal material from a supplier facility, wherein the partially-aged metal material has been solution heat-treated to a stable temper that does not require cold storage before retrogression to obtain the partially-aged metal material;

taper machining the partially-aged metal material;

performing retrogression on the partially-aged metal material by heating the partially-aged metal material to a first temperature;

roll forming the stringer from the partially-aged metal material after performing the retrogression; and heating the stringer to a second temperature reach a final aged state after roll forming, wherein the final aged state is a T6 temper.

11. The method of claim 10, wherein the partially-aged metal material is not placed in cold storage before the roll forming.

12. The method of claim 10, wherein the partially-aged metal material comprises a yield stress between 32 and 50 ksi prior to the retrogression.

13. The method of claim 10, wherein performing the retrogression comprises:

heating the partially-aged metal material to the first temperature of 400-degrees Fahrenheit for less than five minutes.

14. The method of claim 10, wherein the partially-aged metal material is formed by heating a metal material to a temperature of 170- and 190-degrees Fahrenheit for less than four hours.

15. A manufacturing system comprising:

solution heat-treating a metal material to a stable temper that does not require cold storage before retrogression to obtain a partially-aged metal material;

a heating system configured to heat the partially-aged metal material to a first temperature to perform retrogression;

a roll forming system configured to roll form a structure from the partially-aged metal material after performing the retrogression, wherein the partially-aged metal material is not placed in cold storage before the roll forming; and an aging oven configured to heat the structure to a second temperature to reach a final aged state for the structure after roll forming, wherein the final aged state is a T6 temper.

16. The manufacturing system of claim 15 further comprising:

a partial-aging system for the metal material, wherein the partial-aging system is configured to solution heat treat the metal material and heat the metal material to form the partially-aged metal material.

17. The manufacturing system of claim 16, wherein the partially-aged metal material comprises a yield stress between 32 and 50 ksi prior to the retrogression.

18. The manufacturing system of claim 17, wherein the first temperature is approximately 400-degrees Fahrenheit and the heating system is configured to heat the partially-aged metal material at the first temperature for two to five minutes to perform the retrogression.

19. The manufacturing system of claim 18 further comprising:

a monitoring system configured to monitor a state of aging during the retrogression; and a controller configured to determine a cycle time for the retrogression based on the state of aging.

20. The method of claim 1, wherein heating the structure to the second temperature to reach the final aged state after roll forming, comprises:

heating the structure to the second temperature between 200- and 300-degrees Fahrenheit for less than eighteen hours.

* * * * *